United States Patent [19]

Beck

[11] 4,075,593

[45] Feb. 21, 1978

[54] ROTATABLE SHAFT POSITIONING MEANS

[75] Inventor: Willi K. Beck, Hingham, Mass.

[73] Assignee: King-Seely Thermos Co., Ann Arbor, Mich.

[21] Appl. No.: 708,192

[22] Filed: July 23, 1976

Related U.S. Application Data

[60] Division of Ser. No. 557,012, March 10, 1975, which is a continuation of Ser. No. 127,341, March 23, 1971, abandoned.

[51] Int. Cl.[2] ..... H01H 61/08

[52] U.S. Cl. ..... 337/312; 200/4; 337/313

[58] Field of Search ..... 337/312, 313, 115, 316; 74/526, 527, 528, 553, 813 L, 10.2; 236/15 A; 200/4, 11 R, 291, 336

[56] References Cited

U.S. PATENT DOCUMENTS

| | | | |
|---|---|---|---|
| 2,917,942 | 12/1959 | Jarrett et al. | 74/528 |
| 3,019,667 | 2/1962 | Bann | 74/553 |
| 3,183,329 | 5/1965 | Dahlgren | 337/312 |
| 3,197,595 | 7/1965 | Weber | 337/313 |
| 3,232,124 | 2/1966 | Weber | 74/10.2 |
| 3,344,252 | 9/1967 | Hummel et al. | 337/312 |

*Primary Examiner*—Harold Broome

*Attorney, Agent, or Firm*—Harness, Dickey & Pierce

[57] ABSTRACT

A thermally actuated switch including a motive member which is adapted to move one contact either toward or away from its opposed mating contact in response to an increase or decrease in pressure in a fluid actuating heat sensing system, the fluid system translating temperature into fluid pressure. The assembly further includes a hydraulically actuated high temperature switch which is adapted to be rendered responsive to a preselected temperature, as for example, 550° to 600°, the switch being utilized to control an external circuit, as for example, the deactivation of a door lock solenoid. The switch assembly includes two fixed contacts, the positions of which are fixed in response to the position of a cam element. A pair of mating movable contacts are controlled by a temperature responsive assembly, which temperature responsive assembly reacts in response to the sensed temperature of an oven. The open and closed attitude of the pairs of movable contacts are determined by the relative differential between the set temperature and the sensed temperature, the open and closed attitude of one set of movable contacts being controlled in a cooking range of temperatures and the open and closed attitude of the other set of movable contacts are controlled in response to the sensing of a self-cleaning range of temperatures.

18 Claims, 13 Drawing Figures

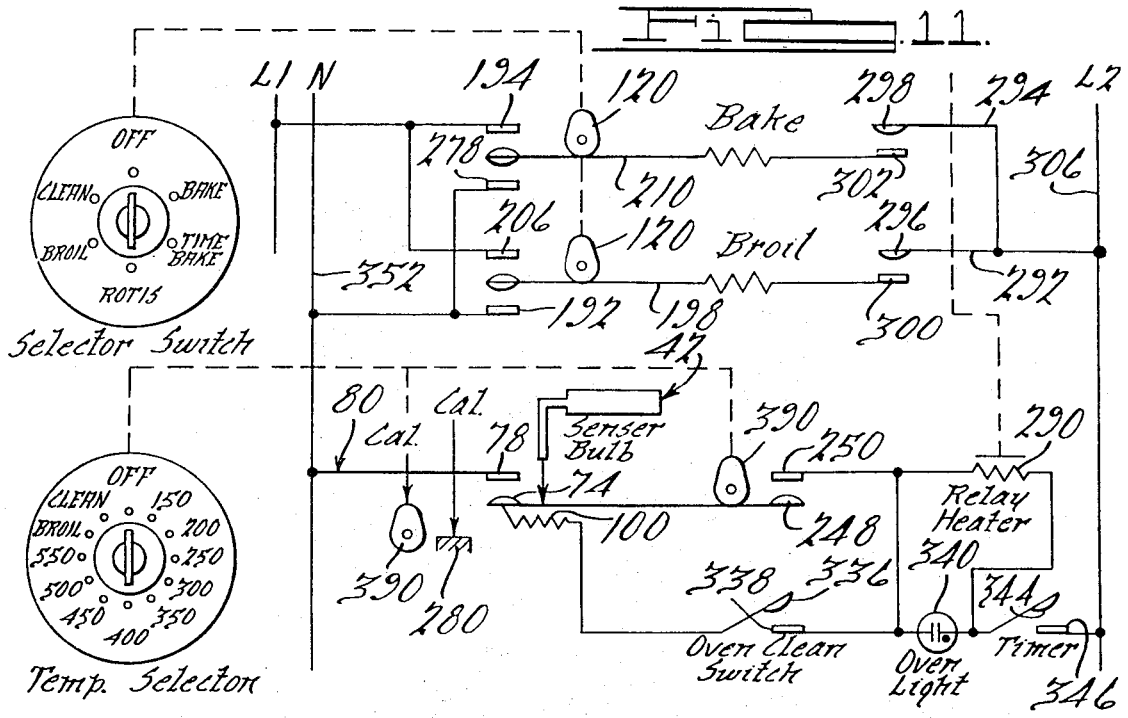
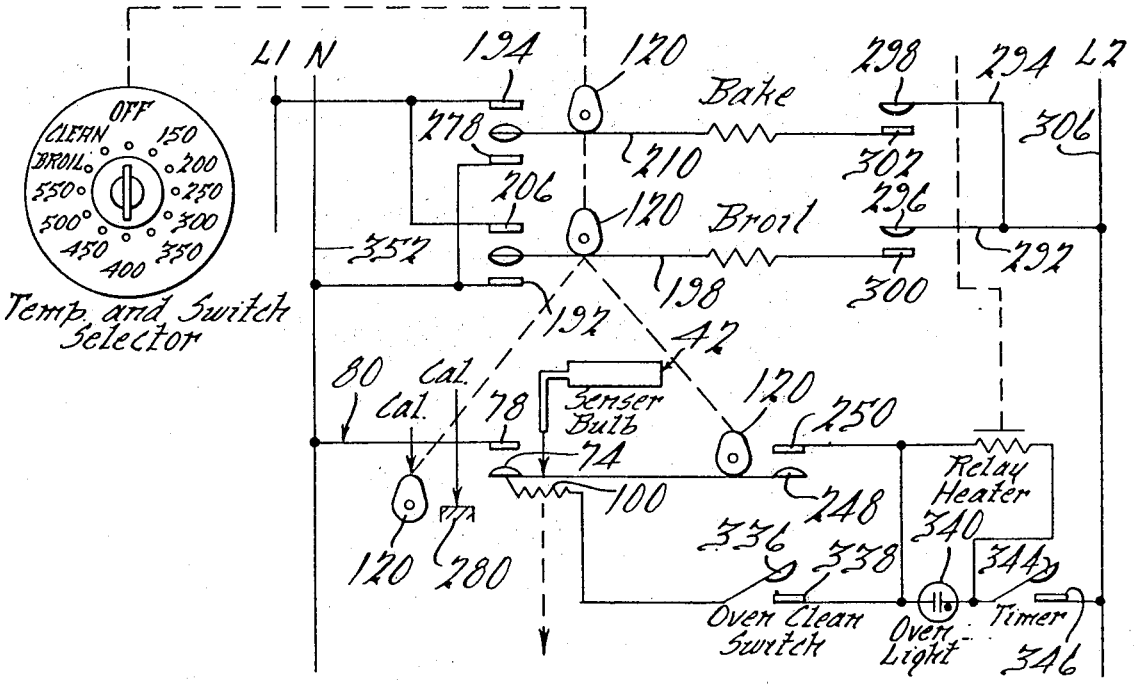
Fig. 13.

ROTATABLE SHAFT POSITIONING MEANS

This is a division, of application Ser. No. 557,012, filed Mar. 10, 1975, which is a continuation of application Ser. No. 127,341, filed Mar. 23, 1971, now abandoned.

BACKGROUND AND SUMMARY OF THE INVENTION

This invention relates generally to a controller switch assembly and an associated circuitry therefor and more particularly to a hydraulically actuated controller and control circuit which are particularly adaptable for use in connection with controlling the environment temperature in an oven both in the cooking range of temperatures and the self-clean range of temperatures.

In providing a controller switch assembly for use in connection with controlling the environmental temperature of an oven, both in the cooking and self-clean temperature ranges, it has been found that certain features are desirable in order to perform the cooking and self-cleaning operations while also providing a relative degree of safety for the user of the system. Further, the use of ovens in the elevated temperature ranges, as for example, 950° to 1100° F., creates additional problems in providing an oven temperature senser which is capable of responding to a large range of temperatures while maintaining a reasonable degree of accuracy throughout the range. Also, the improvement of the contact action in the elevated temperature range has been found to be desirable to maintain the desired head delivery to the oven.

As to providing a certain degree of safety in utilizing an oven in the self-clean temperature range, an assembly and attendant circuitry is provided to insure that the door is both closed and locked before self-clean temperature ranges are achieved and also to insure that the door may not be unlocked while the oven cavity is in the self-clean temperature range.

Accordingly, it is one object of the present invention to provide an improved controller switch assembly.

Is is another object of the present invention to provide an improved controller switch assembly which may be utilized in both the cooking and self-clean temperature ranges.

It is another object of the present invention to provide an improved controller assembly having a hydraulically actuated high temperature switch arrangement.

It is still another object of the present invention to provide an improved controller assembly having an improved high temperature switch which may be utilized to control an external system or device in response to the sensing of a preselected temperature.

It is a further object of the present invention to provide a switch assembly having an improved overclosure heater system for improving the contact action of the switch.

It is still another object of the present invention to provide an improved circuit arrangement for controlling the operation of the described overclosure system in response to the selection of a preselected mode of operation of the assembly.

It is still a further object of the present invention to provide an improved system for selectively controlling electrical energy supplied to various load elements connected to the controller assembly.

It is still another object of the present invention to provide an improved circuit to insure that the oven door is both closed and locked before preselected temperature ranges are achieved.

It is another object of the present invention to provide an improved infinite switch having an improved arrangement of camming surfaces to control the voltages being supplied to various load elements.

It is a further object of the present invention to provide an improved switch arrangement for controlling the above-described overclosure heater element.

It is still another object of the present invention to provide an improved detent arrangement on the above-described controller assembly for eliminating the inadvertent selection of certain modes of operation of the system.

It is a further object of the present invention to provide a controller system which is reliable in operation, inexpensive to manufacture and versatile in use.

Further objects, features and advantages of this invention will become apparent from a consideration of the following description, the appended claims and the accompanying drawings in which:

FIG. 9 is a schematic diagram illustrating a preferred method of interconnecting the various circuit elements of the controller switch assembly of FIGS. 1 to 8 and also illustrating the position of a selector knob relative to the various cam positions;

FIG. 10 is a schematic diagram illustrating the circuit details as illustrated in FIG. 9 and additional interconnecting features adapted to be utilized in connection with a self-clean oven control system and a control relay;

FIG. 11 is a schematic diagram illustrating a modified form of the circuit of FIG. 10 and particularly illustrating separate mode control and set temperature control knobs;

Figure 1:
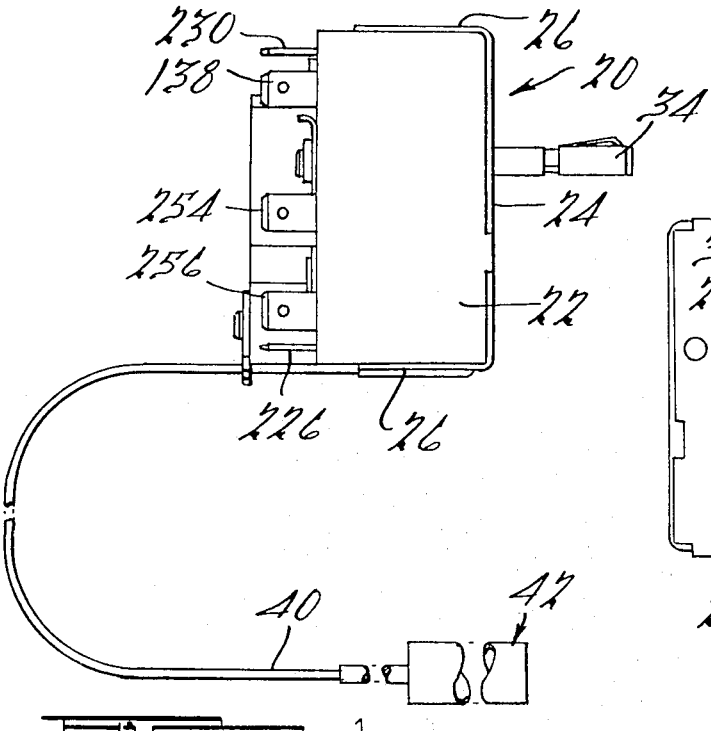
FIG. 1 is a side view of the controller switch assembly incorporating the features of the present invention and particularly illustrating the association of the controller assembly with a hydraulic tube type of senser.
Figure 2:
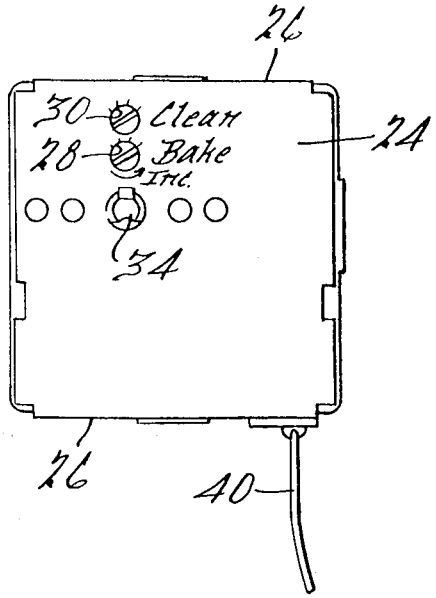
FIG. 2 is a front view of the controller assembly of FIG. 1 and particularly illustrating the clean and bake adjustment screws and the set temperature selection shaft.
Figure 3:
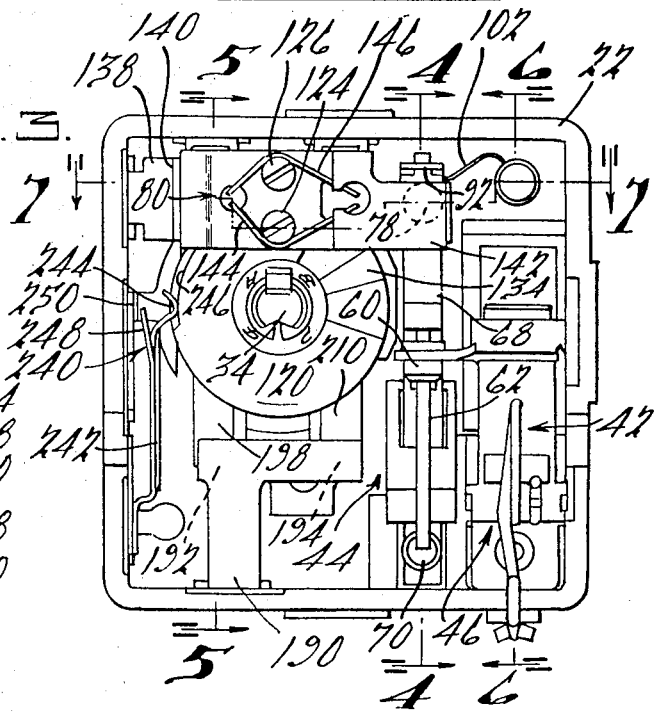
FIG. 3 is a front view of the controller assembly of FIG. 1 with the cover member thereof removed.

In FIGS. 1 to 8 there is illustrated a controller assembly 20, the assembly including a hollow housing 22 formed as a box-like structure having an open side and element supporting appendages integrally formed therewith. The housing 22 may be fabricated of, for example, a rigid phenolic resin molded into the desired shape. The open end of the housing is closed by a cover plate 24, the cover plate being held in place by suitable fastening means 26 taking the form of a pair of tabs integrally formed with the cover 24 and engaging the opposite sides of the housing 22. The cover plate 24 is formed with a pair of calibrating apertures 28, 30 to permit the user to calibrate the switch from the exterior of the housing, as will be more fully explained hereinafter. A shaft 34 is provided and extends through the cover plate 24 axial to the switching housing, the outer end of which may be provided with a knob and a dial (not shown). The indicator legends on the dial provide an indication of the selected temperature level, the dial being oriented with respect to a reference mark on the cover 24 or housing 22.

The control assembly 20 is associated with a hydraulic temperature sensing assembly including a tube 40. The hydraulic sensing assembly may be of the type disclosed in copending application Ser. No. 677,968 filed Oct. 25, 1967, now U.S. Pat. No. 3,513,428, by Will K. Beck and assigned to the assignee of the instant application. The hydraulic senser assembly is adapted to provide a fluid signal to a controller assembly 20 and particularly to a Bourdon tube 42, the Bourdon tube being interconnected in controlling relation with the main contact arm assembly 44 through a connector assembly 46.

Figure 6:
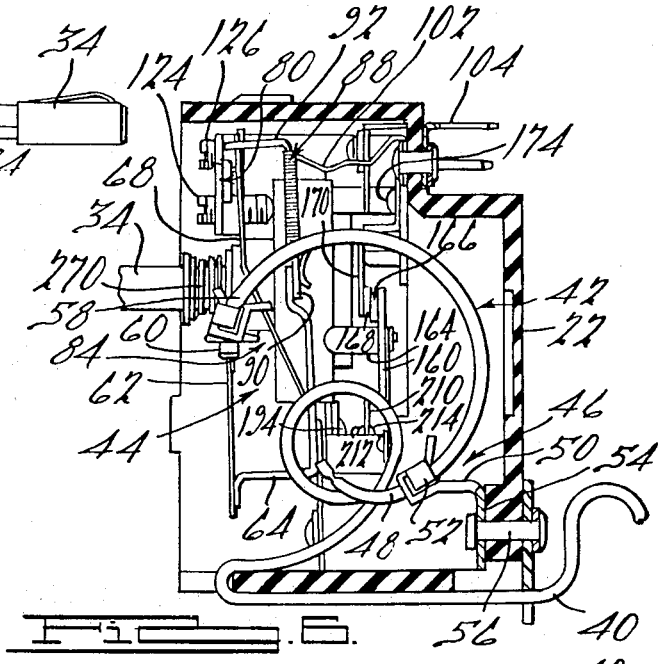
FIG. 6 is still another cross sectional view of the controller assembly of FIG. 3 as taken along line 6—6 thereof.
Figure 7:
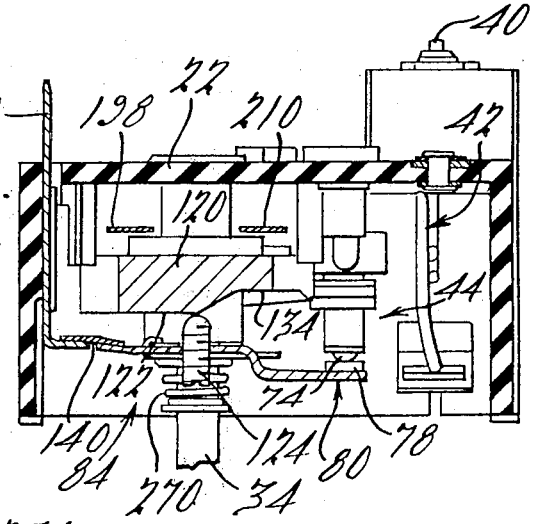
FIG. 7 is still a further cross sectional view of the controller of FIG. 3 taken along line 7—7 thereof.

Referring particularly to FIG. 6, it is seen that the hydraulic tube 40 is connected to the Bourdon tube 42 at 48. The end of the Bourdon tube 42 adjacent the connection 48 is rigidly fixed in a support member 50, the support member being formed with a portion 52 which is adapted to generally enclose and grip the end of the Bourdon tube 42. The support member 50 is also fabricated with a flange portion 54 generally at right angles to the connector portion 52, the flange 54 being connected to the housing 22 by means of a rivet 56.

The increase and decrease in pressure in the tube 40 causes a correlative movement of an end 58 of the Bourdon tube 42, the end 58 moving generally outwardly to increase the radius of the tube 42 in response to an increase of pressure and contrariwise to decrease the radius of the tube 42 in response to a decrease in pressure in the tube 40.

Figure 4:
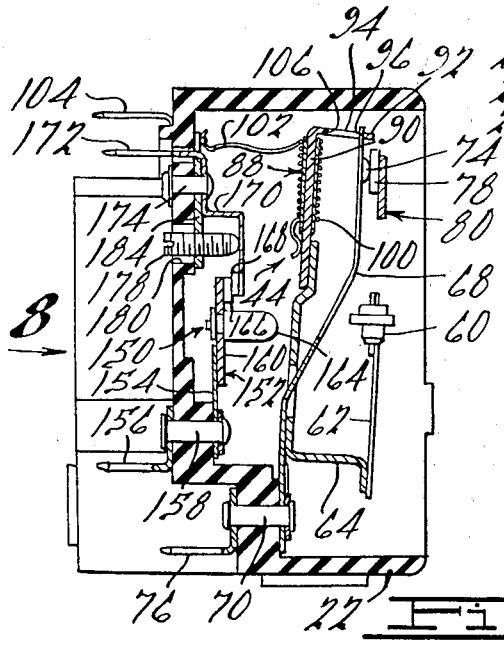
FIG. 4 is a cross sectional view of FIG. 3 taken along line 4—4 thereof.
Figure 5:
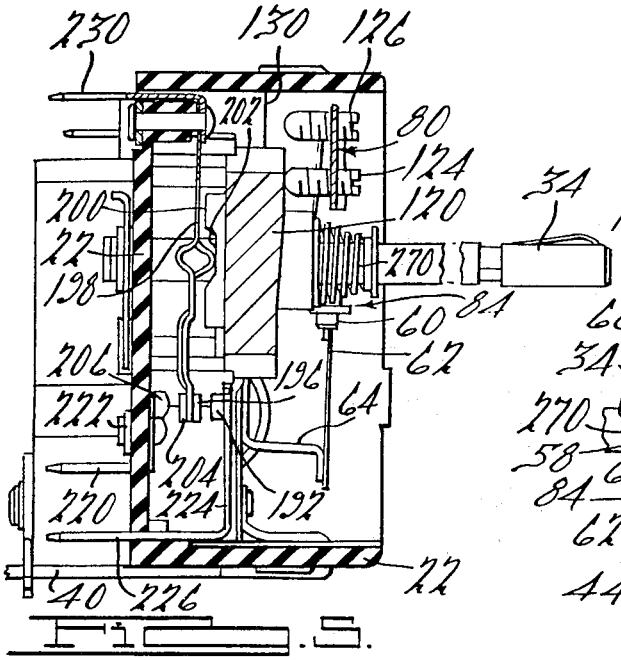
FIG. 5 is another cross sectional view of FIG. 3 taken along line 5—5 thereof.

The motion of the Bourdon tube 42 is translated to the contact carrying arm assembly 44 by means of a coupling member 60 connecting the end 58 of the Bourdon tube to a strip 62 supported in tension between the coupling 60 and a support member 64, the support member 64 being a part of the contact arm assembly 44. These latter details are best illustrated in FIGS. 4 and 6.

The contact arm assembly 44 includes a movable contact carrying first follower arm 68 which is attached at one end thereof to the housing 22 by means of a rivet 70, and the other end is freely movable to control the position of a movable contact 74, supported thereon. The arm 68 is fabricated of a resilient material and forms a current carrying conductor from a terminal 76 to the movable contact 74, through the rivet 70.

The contact 74 is adapted to be placed in mating engagement with a fixed contact 78 supported on a settable arm 80. The inward end and outward position of the arm is set by means of a cam assembly 84 as will be more fully explained hereinafter. The set position of the arm 80 determines the selected temperature at which the mating contacts 74, 78 will open. The resiliency of the arm 68 permits a certain degree of overclosure of the contacts 74, 78 to insure good contact action during a major portion of the temperature rise and also permits the selection of a particular operating temperature within the oven cavity.

Thus, when the radius of the Bourbon tube assembly 42 is increased, a greater tensioning force is applied to tension member 62 through the connector 60. This force is further applied to the member 64 and thus to the arm 68 attached thereto. As was stated above, the arm 68 is formed of flexible material to permit the bending movement of the flexible arm between rivet 70 and the attachment of portion 64 to the arm 68 thus permitting the movement of the Bourdon tube assembly 42 to be transmitted to the arm 68.

The member 64 further is utilized as a contact overclosure mechanism wherein the member 64 is attached to a bimetallic member 88. The bimetallic member 88 includes a portion 90 which is attached to the member 64, as for example by welding, and a tab portion 92 is formed at right angles to the main body 90. The portion 92 is formed with an aperture 94 which is adapted to receive the free end of the arm 68, the arm 68 resting against a shoulder portion 96 when the assembly 44 is in the relax state. Upon adjustment of the fixed contact 78 to a preselected set temperature, the contact 74 is moved to the left as viewed in FIG. 4, thus moving the free end of the arm 68 upwardly in the aperture 94.

The bimetal portion 90 is provided with a heater member 100 which is wrapped in heat transfer relation therewith. A circuit is formed for the heater 100 by means of the member 64, the arm 68, the rivet 70, terminal 76 at one end thereof and by means of a pigtail 102 connected to a terminal 104. The heater 100 is adapted to be energized only during certain modes of operation of the system. In the preferred embodiment, and as will be seen from a description of FIGS. 9 to 13, an oven clean switch is connected in series circuit with the heater 100 to energize the heater 100 only during a period in which the clean mode is selected. The energization of the heater winding 100 causes the movement of the tab portion 92 to the right, as viewed in FIG. 4, thus causing the free end of member 68 to move further into the aperture 94 and increase the contact closure by permitting the spring of member 68 to have a greater effect. With sufficient movement, the free end of member 68 will engage shoulder 106 to cause a greater contact pressure to occur between contacts 74 and 78. In this way the contact action of mating contacts 74, 78 is greatly enhanced during the self-clean mode.

As stated above, the set contact 78 and arm 80 are adapted to be adjustably positioned to select a temperature to which the environment is to be elevated. This adjustment assembly 84 includes a cam member 120, the cam member 120 including a plurality of camming surfaces, one surface of which 122 is adapted to engage a follower pin 124 which is in threaded engagement with the follower member 80, the cam surface 122 being of the infinitely varying type. The member 80 further includes a second follower pin 126 which does not engage the camming surface 122, but is adapted to engage a raised shoulder 130 formed integrally with the housing 22 (see FIG. 5).

The follower pin 124 is utilized to fix the set temperature of the follower arm 80 while the oven is being utilized in the cooking ranges of temperatures from room temperature to 550° F. The camming surface 122 is formed with a depression 134 which is utilized when the system is in the self-clean range, the depression 134 being of sufficient depth as to preclude the pin 124 from engaging the surface 134 and at the same time permitting pin 126 to engage the shoulder portion 130. The arm 80 is mounted at one end thereof by means of a terminal member 138 and flexible member 140 attached thereto to permit the adjustable positioning of the contact carrying end 142. Thus, as the cam member 120 is rotated, the contact overclosure of contact 78 with respect to contact 74 is increased or decreased depending on the relative position of the pin 124 with respect to cam surface 122. At such time as the pin 124 is positioned over the depressed portion 134, the pin 124 is relieved from engagement with the camming surface 122 and the pin 126 is placed in engagement with the shoulder 130.

The pins 124, 126 are held in position within the apertures in arm 80 by means of a pair of spring members 144, 146, the spring members 144, 146 engaging the threaded portion of the pins 124, 126. The pins 124, 126 are further provided with screw slots at the upper portions thereof to permit the adjustment of the height of the portion of the pins 124, 126 disposed between the member 80 and carrying surface 122 or shoulder 130, respectively, through the apertures discussed in conjunction with FIG. 2.

Referring now to FIGS. 4 and 6, there is illustrated a fixed temperature switch 150, which is operated in response to the sensing of a preselected temperature within the environment, as for example, in the oven. The switch assembly 150 includes a second follower arm assembly 152 which includes a resilient member 154 rigidly attached to the housing and to a terminal 156 by means of a rivet 158. The follower assembly 152 further includes a contact carrying member 160 which is rigidly attached to the flexible member 154, as for example, by welding, and a follower pin 164 is fixed to the member 160 by a washer. The follower arm assembly 152 is adapted to support and control the operation of a movable contact 166 to control the engagement and disengagement of the contact 166 with respect to a fixed contact 168. Contact carrying arm assembly 44, first follower arm 68 and second follower arm assembly 152 form a driving arm assembly.

The fixed contact 168 is adjustably supported relative to the housing 22 by means of an arm 170, the arm 170 being integrally formed with an output terminal 172, and the arm 170 is fixed to the base by means of a rivet 174. The adjustment, and thus the temperature at which the assembly 150 will respond, is varied by means of a threaded pin 178, the pin being threaded through an aperture 180 in the housing 22 and an internally threaded member 184. The threaded member 184 is also fixed to the housing by means of the rivet 174. Thus, by advancement of the pin 178, the amount of contact closure of mating contacts 166, 168 is varied.

The follower pin 164 is adapted to be engaged by the member 64 in reponse to movement of the member 64 due to the motion of the Bourdon tube 42. It will be noted that the motion of the Bourdon tube 42, and thus the member 64, is directly related to the sensed temperature of the oven. In this way, a preselected temperature may be selected by means of pins 178, and the engagement of the member 64 with the pin 164 will cause the opening of contacts 166, 168 at the preselected temperature. In the particular system disclosed, the contacts 166, 168 are adapted to control the enabling and disabling circuit for the door lock solenoid, as will be further explained in conjunction with the explanation of FIGS. 9 to 13. In the preferred system, the door lock solenoid is required to be energized in order to permit the user to open the door. Thus, it is seen that the user is precluded from operating the lock latch once the preselected temperature selected by means of pin 178 is achieved.

The controller assembly of the present invention has been provided with the capability of controlling, in addition to the control provided by the above-mentioned contacts 74, 78, the various combinations of energizing a plurality of separate loads, as for example, the bake and broil heater coils of the oven. This control is provided through a circuit which includes a terminal member 190 (FIG. 3) which also acts as a support member for a pair of fixed contacts 192, 194. The fixed contact 192 is adapted to be placed in mating engagement with a movable contact 196 mounted on a follower arm 198. The follower arm 198 is in engagement with a cam surface 200 on the bottom of the cam member 120. The cam surface 200 is provided with a plurality of indentations (one of which is shown at 202) to control the movement of the arm 198.

The particular indentation illustrated at 202 positions the arm 198 at its neutral or midpoint position wherein the contacts 192, 196 are out of engagement and also a second pair of contacts 204, 206 are also out of engagement. For purposes of discussion, the follower arm 198 and its associated contacts 192, 196, 204 and 206, will be described in their operation and relationship to the camming surface 200. In this regard, it is to be understood that the contact 194 is also adapted to be associated with a second follower arm 210 as particularly seen in FIG. 6. The follower arm 210 is adapted to support a pair of movable contacts 212, 214, the contact 212 being adapted to be placed in mating engagement with the fixed contact 194 and the contact 214 being matable with another fixed contact (not shown).

The operation of the two arms 198, 210 is identical with the exception that the camming surfaces in engagement with each follower arm may differ depending upon the particular position of the shaft 34 for the particular mode of operation selected by the controller knob. The contact 206 is connected to an input terminal 220, the terminal 220 being rigidly fixed to the base 22 by means of a rivet 222. Similarly, the contact 192 is supported on the terminal member 190, the shaft 226 of the terminal passing through the base of the housing 22 which provides a friction support therefor.

In the particular illustrated embodiment, the contact 192 is energized with one magnitude of alternating current energy, as for example, 230 volts, through a connection to a source of electrical energy by means of terminal 226. The other contact 206 is connected to a second source of electrical energy, as for example, a 115-volt alternating current source, through terminal 220. Thus, when the contact 196 is in engagement with contact 192, a circuit is completed through the follower arm 198 to an output terminal 230, the terminal 230 being connected to the other side of the line of the source of alternating current. As will be seen from a description in FIGS. 9 to 13, a particular heater may be connected to terminal 230, as for example, the bake heater or the broil heater. The particular circuit just described, in the preferred system, provides electrical energy to the broil circuit and the circuit through follower arm 210 provides electrical energy to the bake circuit.

The controller assembly is provided with an "on-off" switch assembly 240 which includes a follower arm 242 having a bight portion 244 which is adapted to engage a cam surface 246 on the cam member 120. The assembly 240 also includes a movable contact 248 which is adapted to engage a fixed contact 250 when the bight portion 244 is in engagement with a raised portion of the cam surface 246. With the follower arm 242 in the position shown in FIG. 3, the "on-off" switch is in the "off" position thereby disconnecting the controller assembly from the external load connected thereto. The "on-off" switch controls the circuit connected to terminals 254, 256, these terminals being connected as disclosed in FIGS. 9 to 13.

Figure 8:
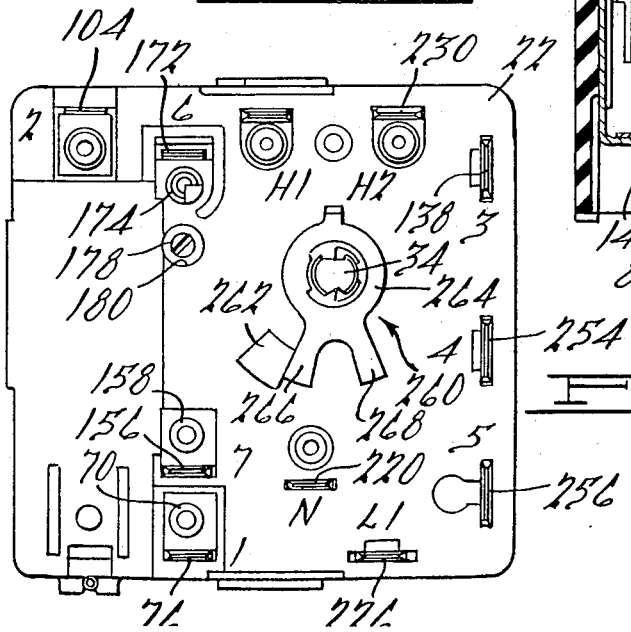
FIG. 8 is a view of the back portion of the housing assembly of the controller of FIG. 1 and particularly illustrating the set temperature knob detent assembly.
Figure 1:
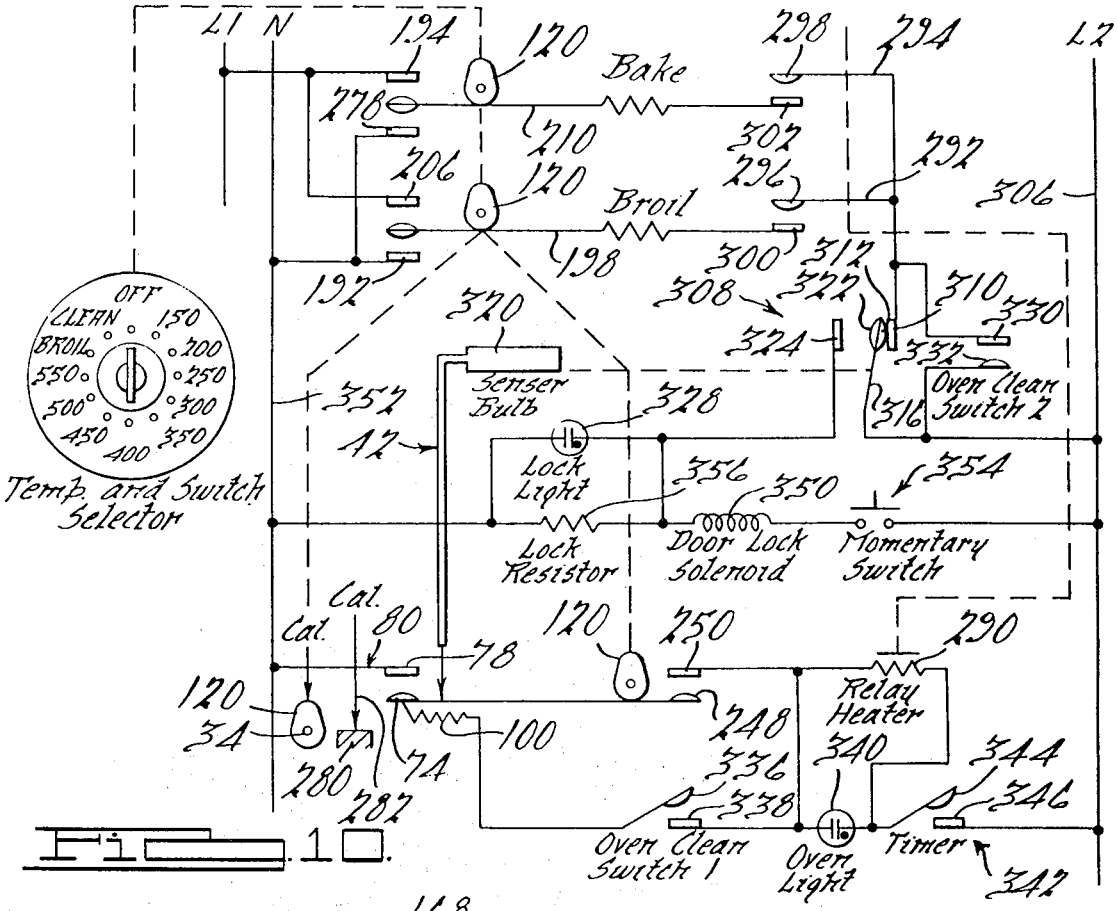

Referring to FIG. 8, there is illustrated a detent assembly 260 connected to the end of knob shaft 34 by any suitable means. The detent assembly is seen to include a shoulder portion 262 and a detent member 264, the detent member being free to rotate in an arc which is almost equal to 360°. The detent is shown with the controller in the "off" position, the leg 266 being in engagement with the shoulder 262. If the shaft 34 is rotated to the other extreme position, wherein the leg 268 is in engagement with the shoulder 262, the broil position has been selected by the user. However, if the user desires to select the "clean" mode, it is necessary that the shaft 34 be pushed inwardly to permit the legs 264, 268 to clear the shoulder 262. The shaft is then rotated a few degrees to permit the legs 266, 268 to straddle the shoulder 262. The shaft 34 is resiliently biased outwardly by the ends of a spring 270 such that a pushing and turning movement must be performed by the user. In this way, the user may not inadvertently set the controller assembly 20 to the clean position.

Referring now to the schematic diagrams of FIGS. 9 to 13, and particularly to FIG. 9, there is illustrated several preferred forms of interconnecting the elements of the controller described in FIGS. 1 to 8 and also the manner in which the controller may be associated with external circuits, as for example, a relay for controlling the main power to the heater elements and the door lock circuit. FIG. 9 has been provided with reference numerals corresponding to the reference numerals used in connection with the description of FIGS. 1 to 8. Similarly, the contacts and cams of FIGS. 10 to 13 are also provided with the common reference numerals where appropriate.

Referring to FIGS. 9, it is seen that the main contacts 74, 78 are controlled by means of the senser bulb assembly 42. The senser bulb actuates the contact carrying arm 68, through portion 90, to control the position of movable contact 74 in response to the sensed environmental temperature. The mating contact 78 is adjustably fixed relative to contact 74, the adjustment being made by the cam member 120 in response to the rotation of knob 34. The position of contact 78 may be calibrated to adjust the set temperature to that indicated on a dial 274 by means on the threaded member 124. Accordingly, the contacts 74, 78 are closed when the sensed temperature is below set temperature and are open when the sensed temperature is above the set temperature.

The high temperature switch, including contacts 166, 168, are included in the Bourdon tube actuation system associated with the senser assembly 42 in that the pin 164 is adapted to be engaged by the support member 64. Thus when the support member 64 reaches a preselected temperature, the pin 164 is engaged to open contacts 166, 168.

The cam member 120 is also adapted to control the quantity of electrical energy which is being fed to the broil and bake windings connected to output terminals 230 and 276, respectively. The cam surfaces on cam 120 are adapted to control the relative position of support arms 198, 210, thus controlling the relative position of contact elements 204, 196 and 212, 214, respectively. With the cam in the position shown, the contact arms 198, 210 are in the middle position. With the cam 120 rotated in the clockwise direction by 90°, the contacts 196, 192 are in mating engagement as would the contact 212 be in mating engagement with a contact 278. Thus the load connected in circuit with these contacts are connected across 115 volts electrical energy between lines L2 and neutral, as will be more clearly seen from a description of FIG. 10. Similarly, the bake winding would also be connected across 115 volts alternating current potential.

With the cams rotated such that an extremely low position on the cam surface is achieved, the contacts 204, 206 are in mating engagement as are the contacts 194, 214. In this situation the bake and broil elements are connected across the 230-volt potential in the preferred system. An "on-off" switch including contacts 248, 250 is also controlled by a surface on cam 120 such that the contacts 248, 250 are open when the "off" mode has been selected and are closed in all other modes of oven operation.

FIG. 10 illustrates a similar interconnection of the controller elements to that described in conjunction with FIG. 9. Particularly, the main contacts 74, 78 are controlled by the Bourdon tube assembly 42 and the contact 74 is moved away from contact 78 in response to the sensing of a high temperature by the Bourdon tube assembly 42. The fixed position of contact 78 is adjusted by means of the cam 120 on shaft 34 and a means for calibrating the position of the arm 80 with respect to the cam surface is provided by an adjusting screw. Also, the clean position for the contact 78 is provided by a fixed stop 280 which is engaged by means of a calibrating member 282, these elements corresponding to screw 126 and stop 130, respectively. The output of the controller, and particularly the energy controlled by contacts 74, 78, is fed to a relay heater 290 through the "on-off" contacts 248, 250.

The relay heater is adapted to control the position of a pair of contact carrying bimetallic arms 292, 294 which control the position of a pair of movable contacts 296, 298 relative to a pair of fixed contacts 300, 302. Thus, as the sensed temperature reaches the set temperature, the contacts 74, 78 are opened to de-energize the relay heater 290. The de-energization of the relay heater 290 causes bimetallic arms 292, 294 to cool, thus causing the opening of pairs of contacts 296, 300 and 298, 302. The opening of these latter contacts cause the de-energization of the broil and bake heaters, respectively.

The broil and bake heaters are energized by a selectable magnitude of electrical energy in response to the position of arms 198, 210 with respect to the various fixed contacts 192, 206, 194 and 278, as described in conjunction with FIG. 9. The circuit for the broil and bake windings is completed to an L2 conductor 306 by means of a switch assembly 308. The switch assembly in the normal cooking mode of operation includes a fixed contact 310 in mating engagement with a movable contact 312. the contacts 310, 312 complete the circuit to line L2. However, when the system is in the self-clean mode of operation, the contact carrying arm 316 is moved to the left by means of an apparatus in the senser bulb 320, the movement being initiated in response to the achievement of the environment to a preselected fixed high temperature as, for example, 550° to 650°. This temperature indicates that the oven environment is extending from the cooking range to the self-clean range temperatures.

When the contact arm 316 is moved to the left, a contact 322 engages fixed contact 324 to complete a circuit through these latter contacts, and energizes a lock light 328 to indicate that the elevated temperature has been reached. The closure of contacts 322, 324 creates a short circuit across the door lock solenoid 350 to disable the solenoid when the elevated temperature is achieved. The circuit to the bake and broil heaters is completed, in the self-clean mode, through an oven clean switch including a pair of contacts 330, 332 which are manually closed by the user. Accordingly, it is necessary for the user to intentionally select the self-clean mode of operation before the bake and broil heaters may be energized. A preferred senser bulb and switch assembly, including switch 308, is disclosed in copending application to Willi K. Beck, Ser. No. 677,968, filed Oct. 25, 1967, now U.S. Pat. No. 3,513,428, and assigned to the assignee of the instant application.

Referring to the main contacts 74, 78, there is provided the heater winding 100 which is utilized to provide additional contact closure in the self-clean mode of operation, as described in conjunction with FIGS. 1 to 8. This heater winding 100 is controlled by means of an oven clean switch including a pair of contacts 336, 338, also closed manually by the user. The closure of the contacts 336, 338 energizes the heater 100 and also energizes an oven light 340 in the event that a time switch 342 is closed. The timer switch 342 includes a pair of contacts 344, 346 which are controlled by any timing mechanism common in the art. The timer switch 342 also controls the energization of the relay heater 290 in the sense that the relay heater is in series with the contacts 344, 346. Thus, the timer must be in a closed position with the contacts 344, 346 closed as occurs in the time mode in order to provide heat to the relay heater. It is to be noted that the relay heater fails in the safe position, that is, the arms 292, 294 are de-energized and the contacts opened in the event that the relay heater is open circuited.

In order to operate the oven door, it is necessary to energize the door lock solenoid to enable the lock mechanism in order to move the lock lever of the oven to either the locked or unlocked position. The door lock solenoid 350 is energized from the L2 conductor 306 and the neutral conductor 352 through a momentary switch 354 and a lock resistor 356. Accordingly, when the momentary switch 354 is actuated, the door lock solenoid is energized to permit the user to move the door latch from either the lock to the unlock position or from the unlock to the lock position.

FIG. 11 illustrates another form of system for controlling the temperature in an oven cavity, particularly utilizing a controller assembly similar to that illustrated in FIGS. 1 to 8. The system of FIG. 11 includes separate switches to control the mode of operation and to control the temperature which the system is to be set. As was the case of FIG. 10, the main contacts 74, 78 control the electrical energy being fed to the relay heater 290 through the "on-off" contacts 248, 250. This operation assumes that the timer, including timer contacts 344, 346, is actuated. The oven light 340 is provided in circuit with the "on-off" contacts and the timer contacts to indicate the oven temperature has deviated from the set temperature and that the temperature is being elevated. When the temperature selector switch is actuated, the cams 390 are rotated to control the set position of arm 80 and also the condition of "on-off" contacts 248, 250. When the temperature selector knob has been moved to the clean position, the follower arm 80 is controlled by the stop 280 to permit the temperature within the oven cavity to be elevated to the self- clean range.

The bake and broil elements are energized from selectable sources of electrical energy through contacts 194, 278, 206 and 192 as they are engaged by the contacts carried at the end of arms 210 and 198. The circuit is completed through the relay contacts 298, 302 and 296, 300 as these latter contacts are closed through the action of the relay heater 290 and the bimetallic arms 292, 294. The engagement of contacts 194, 278, 206 and 192 with the contacts on arms 198, 210 is controlled by a separate mode selector knob controlling cams 120.

The above circuit has been described without the oven door lock solenoid safety system, this system having been described in conjunction with FIG. 10. However, if the oven lock safety system is desired, the circuit of FIG. 12 may be added to the bottom of the circuit disclosed in FIG. 11. Thus, the door lock solenoid 350 is connected across input conductors 352, 306 to energize the door lock solenoid in the event the momentary switch 354 is actuated and the contacts 166, 168 are closed. The contacts 166, 168 are controlled by means of a pin 164 which derives its mechanical movement from an oven temperature sensing mechanism, such as the mechanism described in the copending application Ser. No. 677,968 filed Oct. 25, 1967 of Willi K. Beck, now U.S. Pat. No. 3,513,428 and assigned to the assignee of the instant case, or by the high temperature sensing assembly, including contacts 166, 168 described in conjunction with the description of FIGS. 1 to 8, as illustrated.

The contacts 166, 168 are in the normally closed position to permit the energization of the door lock solenoid when the momentary switch 354 is actuated. However, when the oven cavity temperature achieves a preselected elevated temperature, as for example, 550°, the contact 166 is moved away from contact 168 to break the circuit which includes the door lock solenoid. This precludes the door lock solenoid from enabling the door lock assembly to be moved either from the unlock position to the lock position or from the lock position to the unlock position. A lock resistor 398 has been provided in parallel circuit with the momentary switch 354. The magnitude of the lock resistor 398 is such that the current flowing through the lock resistor 398 is sufficient to actuate the door lock solenoid without actuation of the momentary switch 354. However, the current is sufficient to maintain the lock light 328 energized when the contacts 166, 168 are open.

Figure 12:
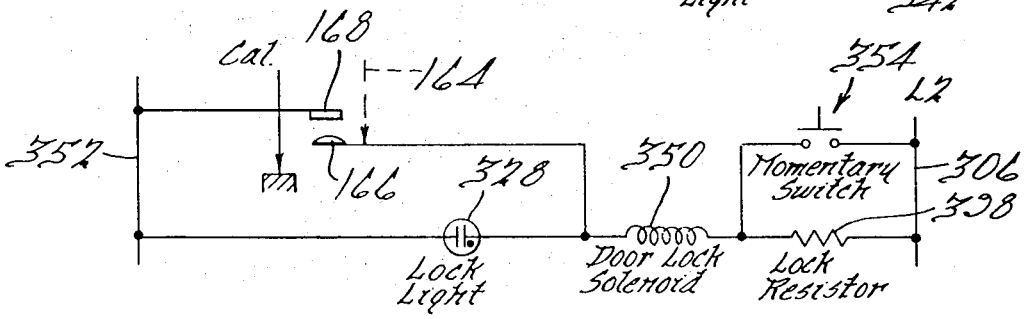
FIG. 12 is a schematic diagram illustrating certain system features which may be added to the schematic diagram illustrated in FIG. 11.
Figure 13:
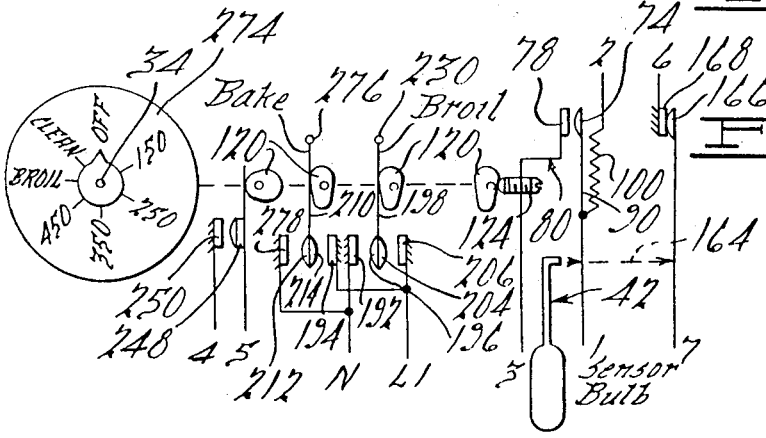
FIG. 13 is another modified form of schematic diagram illustrating still a further form of interconnection of the controller assembly of FIGS. 1 to 8.

FIG. 13 illustrates a circuit which is identical to the circuit disclosed in FIG. 11 with the exception that a single temperature and switch selector knob is utilized to actuate the single cam 120. The circuit of FIG. 12 is capable of being added to the circuit of FIG. 13 to provide the door lock solenoid safety feature and thus require the user to select the self-clean mode and lock the door of the oven prior to achieving self-clean temperatures. The closing and locking of the door enables the self-clean switches described above.

While it will be apparent that the embodiments of the invention herein disclosed are well calculated to fulfill the objects of the invention, it will be appreciated that the invention is susceptible to modification, variation and change without departing from the proper scope or fair meaning of the subjoined claims.

I claim:

1. A rotatable shaft positioning means comprising a support housing assembly, including a shaft supported in said housing for rotational and axial movement relative to said housing, a plurality of contact pairs disposed within said housing, contact positioning means fixedly secured to said shaft and operative to selectively position said contact pairs in mated or open position, resilient means for biasing said shaft in a first axial direction relative to said housing, a detent member axially and rotatably fixed to said shaft, and shoulder means fixedly supported relative to said housing adjacent said detent member, said detent member engaging said shoulder during a predetermined arc of rotation of said shaft and axial movement of said shaft in a direction opposite to said first direction, said detent member and said shoulder coacting to rotatably fix said shaft relative to said housing.

2. The rotatable shaft positioning means of claim 1 wherein said shoulder is mounted on an opposite side of a portion of said housing assembly relative to a major portion of said shaft.

3. The rotatable shaft positioning means of claim 2 wherein said shoulder and detent member are mounted outside said housing adjacent an enclosure wall thereof, and said resilient means acts to bias said detent member toward said enclosure wall in the plane of said shoulder.

4. The rotatable shaft positioning means of claim 3 wherein said detent means is adapted to be moved axially away from said well against the bias of said resilient member out of the plane of said shoulder.

5. The rotatable shaft positioning means of claim 4 wherein said detent member is adapted to be rotated by said shaft to a position overlying said shoulder.

6. The rotatable shaft positioning means of claim 5 wherein said detent member includes leg means which are adapted to straddle said shoulder means upon release of said shaft after moving said shaft against said bias and rotatably positioning said detent member in said overlying position.

7. A rotatable shaft positioning means as set forth in claim 6 wherein said resilient means comprise a spring coaxial with said shaft.

8. A rotatable shaft positioning means as set forth in claim 1 wherein said shaft has means associated therewith adapted to control energy flow from a source to a heater load, in two temperature ranges of operation, said positioning means cooperating with said control means to allow said control means to be selectively moved from a first temperature range of operation to a second temperature range of operation.

9. A rotatably shaft positioning means comprising a support housing assembly, including a shaft supported in said housing for rotational and axial movement relative to said housing, means associated therewith adapted to control energy flow from a source to a heater load in two temperature ranges of operation, said positioning means cooperating with said control means to allow said control means to be selectively moved from a first temperature range of operation to a second temperature range of operation, resilient means for biasing said shaft in a first axial direction relative to said housing, a detent member axially and rotatably fixed to said shaft, and shoulder means fixedly supported relative to said housing adjacent said detent member, said detent member engaging said shoulder during a predetermined arc of rotation of said shaft and axial movement of said shaft in a direction opposite to said first direction, said detent member and said shoulder coacting to rotatably fix said shaft relative to said housing, said control means further comprising first matable fixed and movable contacts, second fixed and movable contacts, said rotatable shaft being rotatable by the user to select one of said first and second ranges of operation. an inclined plane surface rotatable by the rotatable shaft for varying the fixed position of the first fixed contact, calibrating means for setting the fixed position of the second fixed contact, a fluid activated temperature responsive means, a driving assembly driven by the temperature responsive means and operably connected to said first movable contact to move it relative to said first fixed contact to control said first temperature range of operation and operably connected to said second movable contact at a higher temperature range of operation to move it relative to said second fixed contact.

10. A thermal controller for controlling electrical energy being supplied to an oven having both a cooking range of temperatures and at least one self-clean temperature comprising a support housing assembly, an operation selector assembly including a shaft supported in said housing for rotational and axial movement relative to said housing, a first set of contacts operable to control electrical energy being supplied to said oven within said cooking range of temperatures, a second set of contacts operable to control electrical energy being supplied to said oven during an operation at said self-clean temperature, resilient means for biasing said shaft in a first axial direction relative to said housing, a detent member axially and rotatably fixed to said shaft, and shoulder means fixedly supported relative to said housing adjacent said detent member, said detent member engaging said shoulder during a predetermined arc of rotation of said shaft and axial movement of said shaft in a direction opposite to said first direction, said detent member and said shoulder coacting to rotatably fix said shaft relative to said housing thereby positioning said second set of contacts in operable position.

11. A thermal control for controlling electrical energy being supplied to an oven having both a cooking range of temperatures and at least one self-clean temperature comprising a support housing assembly, an operation selector assembly including a shaft supported in said housing for rotational and axial movement relative to said housing, resilient means for biasing said shaft in a first axial direction relative to said housing, a detent member axially and rotatably fixed to said shaft, said shoulder means fixedly supported relative to said housing adjacent said detent member, said detent member engaging said shoulder during a predetermined arc of rotation of said shaft and axial movement of said shaft in a direction opposite to said first direction, said detent member and said shoulder coacting to rotatably fix said shaft relative to said housing, said operation selector assembly further comprising first matable fixed and movable contacts mounted relative to said housing, second fixed and movable contacts mounted relative to said housing, said rotatable shaft being rotatable by the user relative to said housing to select the cooking temperature, a fixed temperature assembly including an inclined plane surface rotatable by the rotatable shaft for varying the fixed position of the first fixed contact, said controller having means movably mounted relative to said plane surface for movably supporting said first and second movable contacts, and said controller including calibrating means for setting the fixed position of the second fixed contact relative to said housing, a fluid activated temperature responsive means, a driving assembly driven by the fluid activated temperature responsive means and including said movable supporting means for moving first movable contact relative to said first fixed contact to control the cooking temperature and said second movable contact at a higher temperature in the self-clean range to move said second movable contact relative to said second fixed contact.

12. A controller as set forth in claim 11 wherein said shoulder is mounted on an opposite side of a portion of said housing assembly relative to a major portion of said shaft.

13. A controller as set forth in claim 12 wherein said shoulder and detent member are mounted outside said housing adjacent an enclosure wall thereof, and said resilient means acts to bias said detent member toward said enclosure wall in the plane of said shoulder.

14. A controller as set forth in claim 13 wherein said detent member is adapted to be moved axially away from said wall against the bias of said resilient means out of the plane of said shoulder.

15. A controller as set forth in claim 14 wherein said detent member is adapted to be rotated by said shaft to a position overlying said shoulder.

16. A controller as set forth in claim 15 wherein said detent member includes leg means which are adapted to straddle said shoulder upon release of said shaft after moving said shaft against said bias and rotatably positioning said detent member in said overlying position.

17. A controller as set forth in claim 11 wherein said movable supporting means including a first follower arm and said driving assembly including a second follower arm, said first movable contact being supported for movement on said first follower arm, said second movable contact being supported on said second follower arm, said second follower arm being actuated in response to the movement of said first follower arm.

18. A controller as set forth in claim 17 wherein said fluid activated temperature responsive means is a Bourdon tube having a fixed portion relative to said housing and a movable portion, said movable portion of the Bourdon tube being connected to said driving assembly.

* * * * *

UNITED STATES PATENT AND TRADEMARK OFFICE

CERTIFICATE OF CORRECTION

PATENT NO. : 4,075,593

DATED : February 21, 1978

INVENTOR(S) : Willi K. Beck

It is certified that error appears in the above-identified patent and that said Letters Patent are hereby corrected as shown below:

On Abstract page, under Related U.S. Application Data after "abandoned" insert --which is a continuation of Ser. No. 28,220 filed April 16, 1970, now abandoned, which is a continuation of Ser. No. 678,030 filed October 26, 1967, now abandoned.--

Column 1, line 7, after "doned" insert --which is a continuation of Ser. No. 28,220 filed April 16, 1970, now abandoned, which is a continuation of Ser. No. 678,030 filed October 26, 1967, now abandoned.--

Column 1, line 33, "head" should be --heat--
Column 3, line 13, "switching" should be --switch--
Column 3, line 23, "Will" should be --Willi--
Column 5, line 64, "pins" should be --pin--
Column 7, line 60, "on" should be --of--
Column 9, line 37, "time" should be --timer--
Column 11, line 39, "means" should be --member--
Column 11, line 40, "well" should be --wall--
Column 11, line 41, "member" should be --means--
Column 11, line 47, after "shoulder" delete --means--

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*